United States Patent [19]

Jeske et al.

[11] Patent Number: 4,973,039

[45] Date of Patent: Nov. 27, 1990

[54] DEVICE FOR RETARDING SHEET STACKS

[75] Inventors: Erwin Jeske; Walter Schaich; Uwe Hartmann, all of Neuffen, Fed. Rep. of Germany

[73] Assignee: bielomatik Leuze GmbH & Co., Fed. Rep. of Germany

[21] Appl. No.: 334,095

[22] Filed: Apr. 5, 1989

[30] Foreign Application Priority Data

Apr. 16, 1988 [DE] Fed. Rep. of Germany ..... 3812685

[51] Int. Cl.[5] ..... B65H 1/22; B65H 29/66

[52] U.S. Cl. ..... 271/151; 271/216; 271/182; 271/202; 271/262; 271/273

[58] Field of Search ..... 271/150, 151, 182, 183, 271/202, 216, 262, 263, 273, 274

[56] References Cited

U.S. PATENT DOCUMENTS

| | | | |
|---|---|---|---|
| 3,502,321 | 3/1970 | McWhorter | 271/202 |
| 3,507,489 | 4/1970 | Wilshin et al. | 271/202 |
| 3,975,012 | 8/1976 | Matthews | 271/183 |
| 4,364,552 | 12/1982 | Besemann | 271/182 |
| 4,436,302 | 3/1984 | Frye et al. | 271/183 |

FOREIGN PATENT DOCUMENTS

| | | | |
|---|---|---|---|
| 8317604 | 8/1984 | Fed. Rep. of Germany . | |
| 3409548 | 10/1984 | Fed. Rep. of Germany . | |
| 1158844 | 7/1969 | United Kingdom | 271/182 |

*Primary Examiner*—H. Grant Skaggs

*Attorney, Agent, or Firm*—Eckert Seamans Cherin & Mellott

[57] ABSTRACT

In a conveyor system, a retarder device (1) with a braking gap (40) for the passage of sheet stacks (4) collated with an overlap and regulated by a controller (35) via an actuator (33), the width of the braking gap (40) being positively adjusted, with the slight undersize necessary to generate the braking load, to the current stack height of the section of the stack stream (6) passing the braking gap (40). In this way the braking pressure acting on the stack sheets (4) can be kept substantially constant independently of the stack height. The braking pressure may also be adapted to the sensitivity of the sheet stacks (4) by a braking pressure relief unit in the form of a load relief element (42).

25 Claims, 4 Drawing Sheets

1
2
3
4
6
7
8
9
10
11
12
13
14
15
16
17
18
19
20
21
22
23
24
25
26
27
28
29
30
31
32
34
40
41
54
55
56
57
58
59

DEVICE FOR RETARDING SHEET STACKS

BACKGROUND OF THE INVENTION

1. Field of the Invention

The invention relates, in a conveyor system, to a device for retarding stacks of sheets, each consisting of at least one sheet, intended, for example, to be fed together into a stream, train or chain of overlapping stacks.

2. Prior Art

The next stack of sheets in a sequence of overlapping stacks fed onto a conveyor is generally passed from above onto the stream of stacks which has already been formed and which is travelling at a continuous conveyor speed, at a feed rate greater than the conveyor speed of the stream of stacks at the transfer point, so that the leading end of this new sheet stack overtakes the trailing end of the stream of stacks and is thus deposited overlapping the stream. Once the overlap dimension desired, determined by the degree of overlap, is achieved, the sheet stack most recently fed must be slowed to the conveyor rate referred to, so that it will run synchronously with the stream of stacks as its last component. A braking element forming a braking gap in conjunction with the belt carrying the stack stream, the gap width of which may be adjusted to the stack stream thickness which will vary as a consequence of the overlap, best provides this retardation. The stack thickness of the stack stream can change, particularly in its longitudinal direction or direction of transport, in steps as a result of the overlap, either repeatedly increasing or decreasing or almost continuously. The braking system supplies the braking force by acting on the stack sheet as it is fed with a frictional or braking pressure so that this stack is retarded to the conveyor speed by means of the sliding friction against the stack stream on the one hand and against the braking element on the other. The braking element referred to is provided to brake the stack sheet fed into it by acting, in particular, on its leading end in the direction of feed or transport. Instead of this, or in addition to this, it is also useful, in particular in the case of large sheet lengths, for the sheet to be retarded at its trailing end, so that the sheet is stretched out in the direction of feed or transport under braking. A suction device is used for this purpose, causing the sheet concerned to adhere to the conveyor belt or the individual sheets of the sheet stack to adhere to one another, thereby decelerating them from the higher feed rate to the transport speed of the conveyor. However, the more sheets laying on top of one another in the sheet stack, or the more impermeable the sheets are to air, as is the case, for instance, with coated papers, the more difficult it will be for the suction air to penetrate the individual sheets.

For these reasons it is necessary, particularly in the case of high feed and transport rates or high machine speeds, to provide an additional or different means of retardation, preferably acting on the leading end of each sheet as it is fed. This retardation is best applied mechanically in the manner described by braking friction in the braking gap, which lies for this purpose at the end of a tapered gap narrowing at an acute angle in the direction of feed or transport. It is extremely difficult to adjust the gap width in relation to the particular stack thickness of the constantly varying stack stream currently passing since, on the one hand although a good retarding action is achieved with inadequate gap width, impressions are frequently left on the very sensitive surface of the sheet stacks, and on the other hand, although no impressions are left if the gap width is too great, one or several sheets of a sheet stack may slip through the braking gap or under the braking element with reduced retardation by comparison with the other sheets because of the inadequate retarding action, thereby causing breakdowns. These difficulties are further compounded by the variable stack thickness and also by the fact that the difference between insufficient and excessive gap width is very small.

Attempts have already been made to circumvent these difficulties by making the gap width slightly smaller than the stack height, and allowing this difference to be accommodated by the elastic resilience of the belt. In this case, however, particularly when coated papers are handled, pressure points in the form of strip markings cannot practicably be avoided, as the gap width of the retarder gap can only be adjusted elastically directly by the counter pressure of the stack stream or variably against a preset load. This load has to be relatively high for the sake of rapid adjustment.

SUMMARY OF THE INVENTION

An object of the invention is to provide a retarder device of the kind described, by means of which despite assured retardation, the creation of braking marks on the stacks can be substantially reduced or completely prevented.

According to the present invention, there is provided a retarder device for sheet stacks consisting of at least one sheet fed in a feed direction at a feed rate overlapping a conveyor running more slowly in order to form an overlapped stream of stacks, the device having at least one braking element opposing the conveyor and acting with braking pressure to retard each advanced stack, this element defining, in conjunction with the conveyor, a variable braking gap for the passing stack stream with variable stack height, wherein the braking pressure is adjustable by at least one actuator.

In accordance with the preferred embodiment to be described later, the abovementioned object is achieved by means of a retarder device on which the gap width can be modified in accordance with varying stack height or set via at least one adjuster acting outside the stack stream on at least one of the two elements limiting the gap width, at least partially avoiding the direct influence of the stack flow. In this way the braking pressure may, for instance, be continuously kept substantially constant with varying stack height, without a braking pressure peak being generated on the occurrence of an overlap step. The adjustment is best made such that the gap width is only a few hundredths of a millimeter smaller than the stack height of the section of the stack stream currently passing. This has the substantial advantage that only just sufficient pressure or braking force is exerted on the stacks at the moment they pass into the braking gap, to provide non-damaging retardation so that the stacks are not marked, or any marking is practically imperceptible. An additional advantage is also that even when the machine is run up to speed or if, for instance, a gap is created in the stream of stacks to indicate a change in stack sizes, the braking gap can be modified in a controlled way so that it will even retard the first sheets effectively and can then be gradually expanded in width as the number and/or thickness of overlapped stacks increases the stack height of the stack stream.

It is best if at least one actuating drive is fitted to act on the upper, lower or both limiters of the braking gap to provide the adjustment to be effected simultaneously with the change in stack height or slightly in advance of the stack reaching the braking gap. This actuator is suitably controlled by a controller or regulating device, so that data independent of the machine itself determining the machine status and also measured values determined directly from the stack stream may be used to control the adjustment. Machine-related data may include, for example, the number of individual sheets per stack, the thickness of the individual sheets, the degree of overlap, i.e. the ratio between the length of the sheets and the overlap length, the pressure sensitivity of the sheets and similar values. A measured value may be, for instance, the stack height of the stack stream, or a variation in this, or the detection of a gap in the stream, contact free measurement being conceivable. It is particularly advantageous if the adjustment can also be influenced by a manually enterable correction value, for instance, so that the operator can directly influence the specification of the width of the braking gap on the basis of his observation.

Instead of this, or in addition to this, it is also advantageous if the adjustment is controlled by an electronic slider control detecting the current stack position along the conveyor and the associated speeds.

The present retarder device is suitable for fitting along a conveyor belt after a guillotine used to cut the sheets or sheet stacks from rolled webs. The number of separate sheets per stack placed on top of one another without direct connection is a function of the number of webs, with these webs best being cut laying on top of one another so that all the separate sheets making up each stack are cut in one action, and thus lie precisely flush with each other. This flush position is also maintained in the retarder device zone. The construction described here is particularly suitable for paper sheets or stacks, but may also be suitable for sheets or stacks of another material, for example a film material.

Instead of the construction described, or in addition to this, the invention also provides for variation of the taper angle of the braking and/or gap by means of an adjustment or actuator, with this adjustment being both independent of and a function of the width of the braking gap, of the braking pressure or of any of the data types referred to. The taper angle, most suitably in the order of 10°, can also be adjustable and, in particular, reducible, against the preset load referred to, i.e. a mass load influencing the braking force for example, whilst the width of the braking gap is appropriately expandable against this preset load within a specified tolerance range. The preset load, which in practice amounts to an opening force for said taper angle and a closing force for said braking gap, is appropriately variable, or preferably modifiable to the extent that it can be adjusted and readjusted by means of at least one adjustment action or actuator. If the preset load is determined by a mass load, it can be modified by means of an adjustable, for instance, sprung, load relief.

Instead of the design described, or particularly in addition to this, it is also a substantial advantage if at least one of the two limiters, that is the upper or lower limit of the braking gap is made resilient under compression, in particular if at least one resilient foam layer of polyurethane foam or another suitable plastics is present. In the case of elements which act directly on the sheet stacks through slippage or relative speed, for example the braking element, however, the surfaces coming into direct contact with the paper, i.e. the braking surface for instance, is best made from an extremely smooth plastics layer with the lowest possible coefficient of friction or high sliding capacity, which is either not at all, or only very slightly, elastic under compression as is tetrafluoroethylene, for which reason in this case the layer of material elastic under compression required lies directly beneath this relatively compression resistant layer.

The influences of the actions on the sheet stacks in the braking gap zone referred to, e.g. the braking pressure, the gap form or gap cross-section or similar, can also be created instead of through the design described or additionally to this by changing the position of the two elements defining the braking gap transversely to the direction of measurement of the gap width by an adjustment or by at least one actuator, for which purpose one or both of the limiting elements can be made adjustable against the device console or the machine frame. The capacity to adjust in and against the direction of transport is particularly advantageous. Furthermore, curvature of the conveyor may be adjustable in a zone including the braking gap but extending beyond this in or against the direction of transport. The wear on the braking element can be compensated for by changing this curvature if the leading edge of the braking counter-pressure element fitted to influence the curvature is shifted slightly backwards against the direction of transport from the lowest point of the braking element. If the braking element has a long braking surface along the direction of transport, mounted at a taper angle to the conveyor, relatively large longitudinal displacements of the braking counter-pressure element supporting the conveyor cause very fine modifications of the gap width of the braking gap in the manner of a gear reduction.

BRIEF DESCRIPTION OF THE DRAWINGS

For a better understanding of the invention and to show how the same may be carried into effect, reference will now be made, by way of example, to the accompanying drawings, in which.

DETAILED DESCRIPTION OF THE PREFERRED EMBODIMENTS

Figures 1, 5:
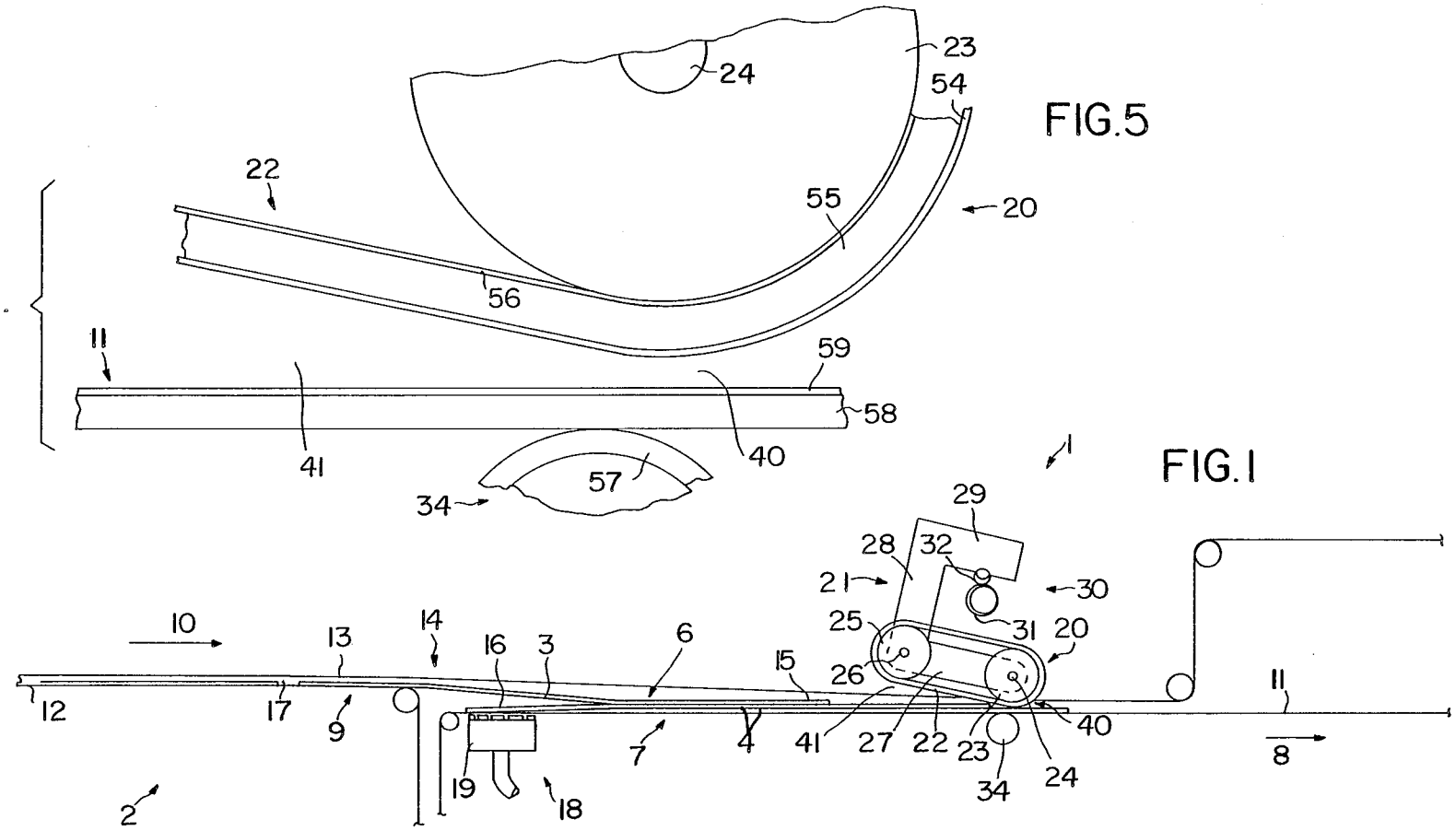
FIG. 1 is a simplified illustration of a retarder device for sheet stacks mounted on a paper processing machine.
FIG. 5 is an enlarged view of a retarder device in the braking zone.
Figure 2:
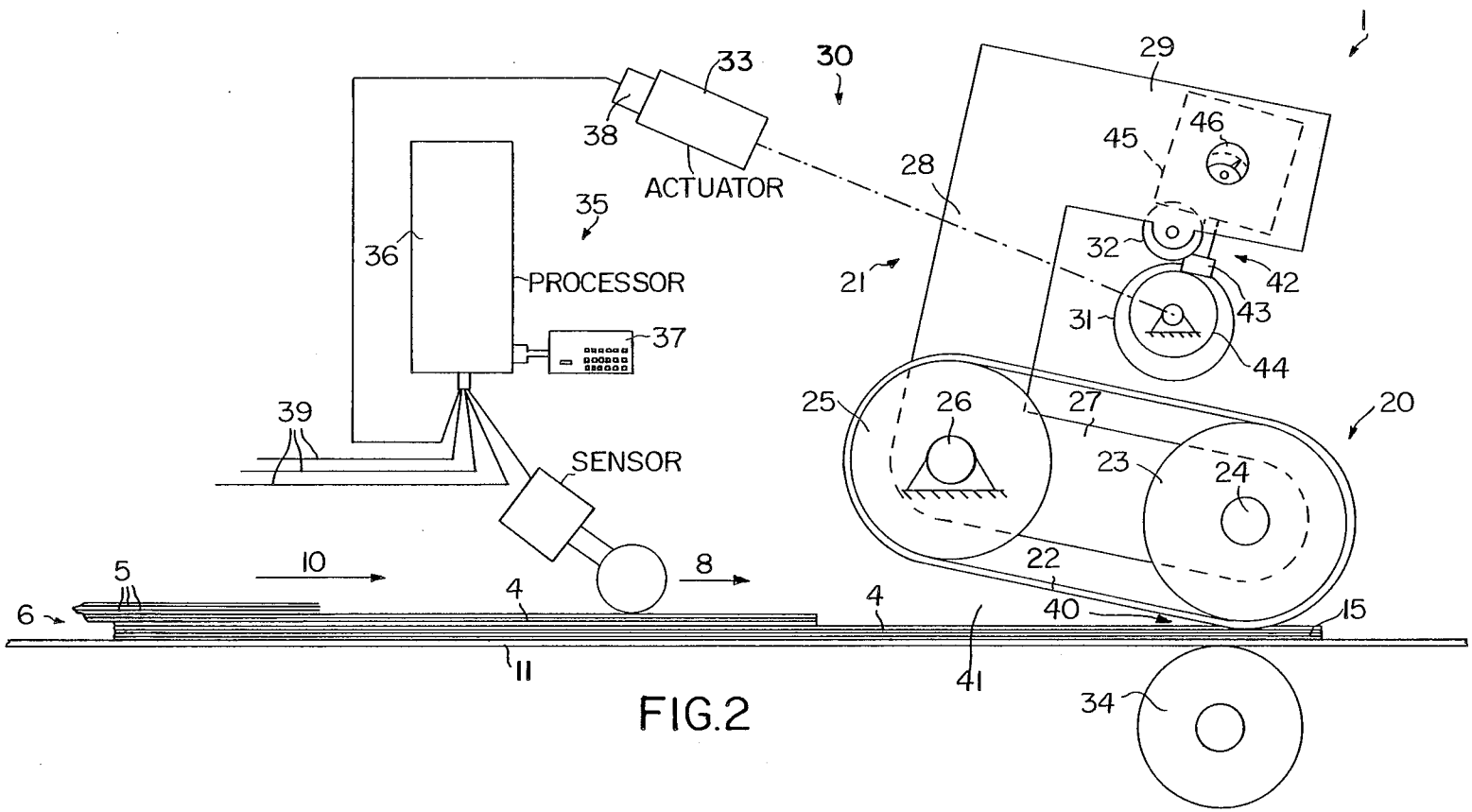
FIG. 2 is a diagrammatic section of FIG. 1 to a greater scale.
Figure 3:
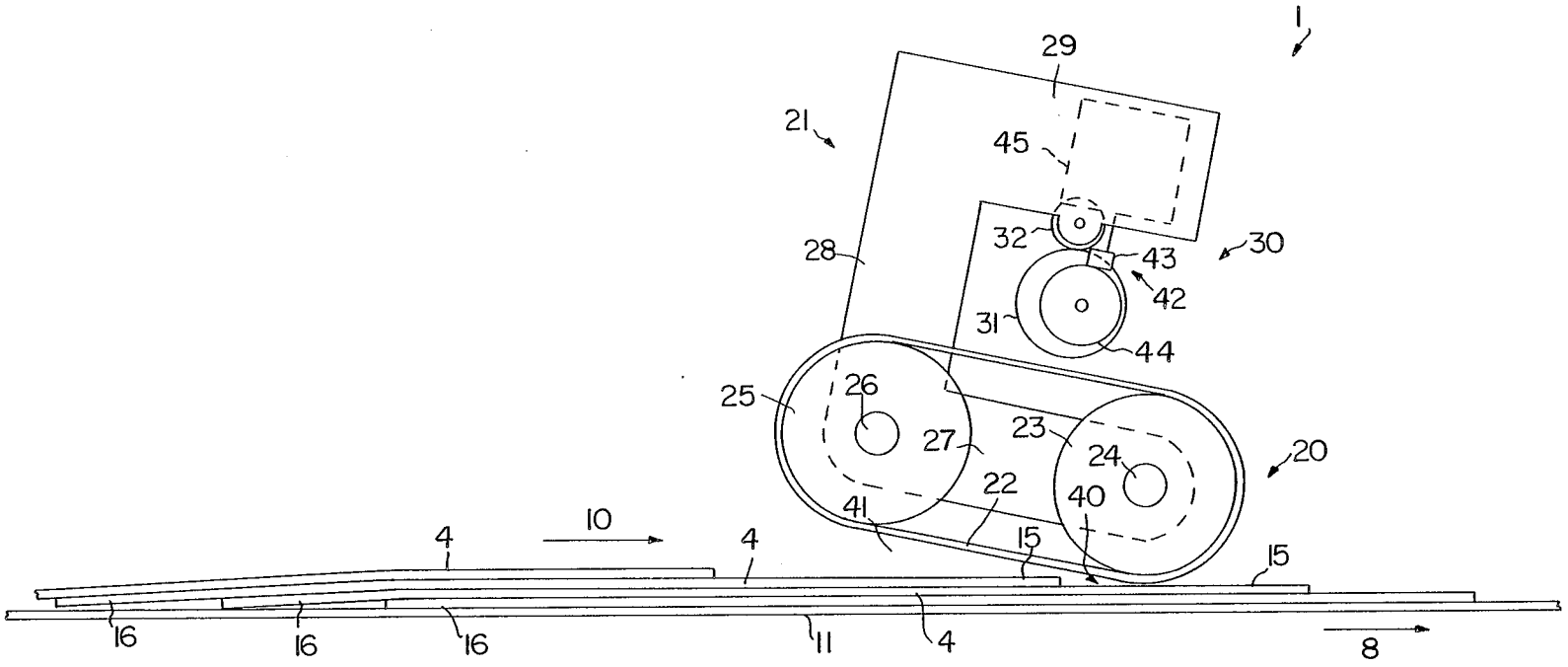
FIG. 3 shows the apparatus basically as illustrated in FIG. 2, but in a different control condition.

A retarder device 1 as described here and illustrated in FIGS. 1 to 3 is mounted along a substantially horizontal conveyor section of a machine 2, by means of which individual sheets 5 of uniform size are cut by a guillotine from paper webs drawn from adjacent storage reels in such a way as to form sheet stacks 3, 4, following one another with an interval in the direction of transport or lying on top of one another, always having the same number of sheets 5 placed flush on top of each other. These sheet stacks, 3, 4, are collated into a stream of stacks 6 in the area of and with the assistance of the device 1, which has been precisely specified so that the serially supplied sheet stacks 3, 4 are placed in a predefined, overlapping relative position, in which they overlap one another, preferably by the same extent, so that an overlapped stack stream 6 is created in which the next upper sheet stack in the sequence is set back by comparison with the leading edge of the sheet stack below this, but that the sides of all sheet stacks are flush.

In the zone of the retarder device 1 there is a conveyor belt 7 associated with the device as its lower braking runner, which extends backwards from the braking zone along its essentially horizontal direction of travel, arrow 8, by a multiple of the overlap distance of the leading edges of the sheet stacks referred to or by at least the length of a sheet stack, measured in this direction of travel, arrow 8, and is also extended correspondingly beyond the braking zone. The conveyor, 7, may, for instance, be made up of several parallel conveyor belts with suction holes, i.e. perforated, separated by narrower gaps. The conveyor belt made up of individual belts is diverted from approximately the vertical at the beginning of the conveyor 7 over a tail pulley to run towards the device 1.

A feeder 9 for the sheet stacks coming directly from the guillotine butts directly up to the beginning of the conveyor 7, its feed plane being substantially parallel to the transport plane of the conveyor 7 and slightly, or a multiple of the sheet stack height, above the transport plane, to leave the leading edge of the feeder 9 higher than the trailing edge of the conveyor 7. A feeder belt 12 of the feeder 9 is also constructed from single belts in the manner described and is guided downwards via a tail pulley immediately past the trailing edge of the belt 7.

To guide the sheet stacks or the stack stream 6, top or covering belts 13 run from a point near the guillotine to beyond the overlap zone or the braking zone of the device 1 a small distance above the conveyor belt 11 and/or the feed belt 12. These top belts are also formed from separate belts in the manner described and can be guided away from the conveyor 7 or conveyor belt 11 over tail pulleys a short distance beyond the braking zone. The top belts 13, illustrated only in FIG. 1 for the sake of simplicity, are guided back over device 1 in a manner not described in more detail, so that they form an endlessly circulating belt, just as do the conveyor belt 11 and the feed belt 12, which are returned underneath. The cover belt 13 runs on or immediately next to the upper sheets of the sheet stacks or stack stream, to prevent them lifting from the belts of the conveyor 7 or feeder 9, even at high running speeds. The direction of feed, arrow 10, of the feeder 9 is identical or parallel to the direction of transport, arrow 8, but the feed rate of the feeder 9 is greater than the transport speed of conveyor 7, while the cover belt 13 should best run at a speed at most no greater than the feed rate. Thus, the cover belt 13 should not be in contact with the stack stream in the braking zone or along the conveyor 7.

At the point where the level changes between the leading edge of the feeder 9 and the trailing edge of the conveyor 7, there is a transition point where the next stack 3 is handed over from the feeder 9 onto the stack or stacks 4 which are already fully positioned on the conveyor 7, and thus onto the stack stream which has already been formed, in such a way that the leading end 15 of this stack 3 overlaps the trailing end 16 of the topmost stack 4 of the stack stream already in position directly beneath it by a preset amount, which can be less than or greater than half of the length of a sheet stack. Because of the higher feed speed of the feeder 9, the sheet stack 3 will be pushed forward on the slower moving stack 4, until it has left the feeder 9 completely and is then decelerated down to the transport speed. The sheets on the feeder 9 are transported with intervals 17 in order to prevent the next sheet on the feeder 9 running onto the previous sheet during the period of retardation.

To delay each sheet stack 3, a trailing end braking device 18 is fitted before the device 1, or immediately at the front end of conveyor 7, acting pneumatically on sheet stack 3. For this purpose, the braking device 18 on the underside of the conveyor belt 11 has a suction head extending across the substantial width of the belt, which intermittently generates a vacuum on the underside of the sheets 5 of each stack through the suction apertures in or between the conveyor belts 11, so that these sheets and thus the complete stack are drawn sliding against the conveyor belt 11 and thus retarded to its transport speed. The suction head is controlled so that it begins to act when each sheet end 16 reaches the transition point 14. The fact that the braking device 18 acts on the trailing end of each stack, ensures that the stack remains stretched under the tensile or transport forces acting on it.

Almost simultaneously with the action of the rearward braking device 18 on the trailing end 16 of each stack of sheets, its leading end 15 reaches the braking zone of the retarder device 1, so that device 1 comes into action immediately the braking device 18 comes into action and then acts simultaneously with it. To achieve this aim, the device 1, or its braking element 20, may be moved along the conveyor 7 in and against the direction of travel, arrow 8, and secured such that the interval between the braking device 18 and device 1 is adjusted to the relevant length of the sheet stacks to be processed. The retarder device 1 has a brake carrier 21, which is suitably constructed as two single bearers located to either side of the conveyor 7, rigidly connected by means of transverse axles or shafts, 24, 26 and mounted on the sides of the machine frame. A roller tail pulley 23 extending across the width of the conveyor 7 is mounted parallel to the conveyor plane and essentially perpendicular to the direction of transport 8 in such a way that it can rotate on the forward axle 24 in the direction of the arrow 8. A second identical or similar tail pulley 25 is mounted to rotate on an axle 26 located at a distance behind this and slightly further above the transport plane. These tail pulleys 23, 25 carry a braking belt 22 substantially shorter than the length of the sheet stacks, most suitably constructed from a number of endless single belts spaced apart side-by-side, so that the individual belts of the cover belt 13 can run through grooves in the tail pulley 23, and between the individual belts of 22 thus preventing them from coming into contact with the sheet stacks, by contrast with the braking belts 22.

The axles 24, 26 are mounted on the forward and rear ends of lower, slightly angled arms 27 projecting freely in the direction of travel, arrow 8, of the basically U-shaped bracket for the brake carrier 21. The brake carrier 21 is attached to the machine frame in such a way as to rotate around an axle located behind the forward axle 24, particularly the rearward axle 26 or an axis lower than this and parallel to the transport plane and substantially perpendicular to the direction of travel, arrow 8, so that the angle of the lower run of the belt 22 declining in the direction of travel, arrow 8, or the distance between the forward tail pulley 23 and the conveyor belt 11 can be varied. Besides the arms 27, the separate parts of the brake carrier 21 have connector pieces 28 pointing upwards and arms 29 substantially parallel to the arms 27, and also pointed forwards, connected to the upper ends of these.

In order to modify the position of the braking element 20 in the manner described, an adjuster device 30 is provided by means of which the distance between the braking element 20 and the conveyor belt 11 can be varied, independently of the brake unit support, either continuously or as a function of the change in height of the stack stream consequent on stack overlap, on the basis of data which may at least partially originate from the other machine controls, i.e. for example from counters for the number of single sheets or of the number of sheet stacks collated to form the stream, and thus are anyway already available on existing machinery. A change of stack if, for example, the number of stacks required to be supplied overlapped on top of one another is reached, and the next overlapped unit is to be supplied directly following this first unit with an appropriate interval, may also constitute an item of data. Furthermore, there can be manual input of such data items, e.g. if the machine is to be restarted after a breakdown and manual clearing of the sheet stacks affected by the breakdown.

The adjuster device 30 acts as a positive lifting device on the brake carrier 21 and only releases it for lowering movements under a preset load; mounted on the machine frame or on its side beams it has at least one adjuster cam 31 on which the brake carrier 21 rests with a counter unit provided in the form of a cam follower 32, or can be raised against the preset load. The adjuster cam 31 is designed in the form of a setting curve, like a circumferential curve, mounted so that it can rotate around an axis substantially parallel to the axis 24 or 26 and designed to have a linear relationship between angle of rotation and curve gradient. The cam follower 32 is constructed as a cylinder or similar roller mounted on rotating bearings on the underside of the upper arm 29 of each bracket for the brake carrier 21, resting on the adjuster cam 31 at its highest point. The axles of the adjuster cam 31 and follower 32 are located above the braking element and axles 24, 26 and approximately centrally between these two axles, related to the direction of travel, arrow 8, so that the adjuster cam 31 can act between the arms 27, 29. The adjuster cam is driven by an actuator in the form of an electric servo motor, for instance, mounted on the machine frame or on the outside of a frame beam; the substantially play-free linkage between this motor and the adjuster cam 31 being constructed as a reduction gear in the form of bevel gears operating in the two opposed directions of rotation.

To provide support against the preset load, or against the braking pressure acting on the conveyor belt 11 from the braking element 20, at least one brake counter-pressure element 34 is provided on the opposite side of the conveyor belt 11 to the braking element 20. This counter-pressure element extends over the width of the conveyor 7 substantially parallel to axle 24 and can be fitted as a rotating cylinder or roller. It is also conceivable, instead of the construction described or in addition to this, that the adjustment procedure described may be effected by positioning the counter-pressure element 34 with an adjuster transverse to the conveyor plane and/or parallel to the direction of travel, arrow 8, which could then result in a correspondingly minor change in the path of the flexible conveyor belt 11 in the braking zone.

The relevant adjuster device 30, or all of them, is controlled by a controller 35 regulating the operation of the appropriate actuator 33, this controller consisting of a processor to convert the data supplied into the appropriate control pulses and an operating panel 37, via which the data referred to can be manually input if required. The controller also has an angle or position sensor 38, which detects the current angle position of the adjuster cam 31, for example through a directly driven connection to the motor shaft of actuator 33 and transmits continuously to processor 36 by means of a data line. Further data lines 39 to the processor 36 transmit the other data referred to, such as the machine status. A sensor operable to sense stream thickness can be included, for example having a sensor roller provided for running on the layer stream as shown in FIG. 2.

The braking element 20 or the lower run of the braking belt 22 and the opposing side of the conveyor belt 11 form a braking gap 40 at the lowest point of the tail pulley 23 narrowing at an acute taper angle in the direction of travel, arrow 8, and then widening in accordance with the curvature of the tail pulley 23. In this gap the sheet stack to be retarded comes under the braking pressure almost linearly over a very short section in contact with the braking element; the gap then changes continuously into an intake gap 41 of approximately the same taper angle extending over the rest of the length of the braking element and in which the sheet stacks or stream of stacks are not in contact with the braking element.

As is shown in particular in FIGS. 2 and 3, the device described operates in the following manner. The operator inputs the number of reels to be used from the reel truck, the paper thickness and the degree of overlap desired; as the machine is started the actuator 33 then rotates the adjuster cams 31 into a position where the forward pulleys 23 are at their closest to the conveyor belt 11, so that the leading edge 15 of the first sheet stack 4 to be advanced is captured and retarded between the tail pulley 23 and the counter-pressure element 34 or the braking belt 22, as shown in FIG. 2. If this sheet stack has decelerated to the lower running speed before the next sheet stack enters the braking zone, then, before the next sheet stack 4 enters the braking gap 40, the processor controlled adjuster device 30 rotates the adjusting cam 31 clockwise into the position shown in FIG. 3, in which the tail pulley 23 is raised by about the height of one sheet stack by means of the runner 32 and the lever-shaped bracket of the brake carrier 21 so that the braking gap 40 is made correspondingly wider. The braking gap 40 is selected to be sufficiently wide for the entry of the leading end of the next sheet stack, that is, it is a few one-hundredths of a millimeter smaller than the total height of the stack stream at this leading end, or of this sheet stack, which will thus be held in the braking gap and retarded. The braking gap is widened in the same way before each subsequent sheet stack enters the braking gap. If an overlapped unit has been completed and it is wished to begin collation of another unit, in which a bottom sheet stack lying flat along its complete length on the conveyor belt 11 is initially to be retarded, the braking gap 40 is again constricted as illustrated in FIG. 2 before this stack enters the braking zone. If the degree of overlap in an overlapped unit is specified such that the leading end of at least one upper sheet stack is positioned behind the trailing end of the lowest sheet stack or of another lower sheet stack, and thus the height of this unit no longer increases, or does not rise uniformly in steps in the opposite direction to the direction of travel, arrow 8, this is also taken into account by the appropriate adjustment of the braking gap 40 in the manner described.

The operator may observe the sheet stacks immediately beyond the braking element 20 in the direction of travel, arrow 8, and inspect them for pressure marks left on the upper sheets of the leading ends of the sheet stacks by the braking element 20. If marks are present an appropriate correction value may be entered on the operating panel 37 to increase the width of the braking gap slightly or to reduce the braking pressure. Thus the braking gap may always be optimally set and regulated as a function of the sheet thickness to ensure that braking never causes damage. A thickness gauge directly measuring the current height of the overlapped unit in relation to the braking zone can be provided both immediately in the area of the braking zone or intake zone or before or beyond this in the form of a feeler roller. As FIG. 2 in particular illustrates, the most forward area of support for conveyor belt 11 in the direction of travel, arrow 8, the counter-pressure element 34, which simultaneously constitutes the sole support line of the counter pressure element 34 if constructed in the form of a counter roll, lies slightly behind, in the opposite direction to the direction of transport, the narrowest point of the braking gap 40, so that the braking belt 11 in the zone of this point can yield elastically slightly under the braking action and the braking action acts over a somewhat longer range, which further helps in ensuring that the paper stacks are undamaged.

Instead of the construction described, but in particular in addition to this, the most important advantages of the device may also be achieved by a load relieving device 42, by means of which the maximum preset load of the braking element and thus the braking force can be adapted to the requirements resulting from overlapping, or on the pressure or surface sensitivity of the sheet stacks. This load relief 42 has at least one support 43 mounted on the brake carrier 21 or laterally on the outside of the upper arm 29 of each bracket and can be moved transversely to the transport plane, in particular being linearly displaceable against a spring load. This support 43 rests on a bearer 44 in a fixed position in respect of its action against the machine frame under the preset load which is approximately in equilibrium with the spring load. In the design example illustrated, the bearer 44 is a cylinder lying in the rotational axis of the adjuster cam 31 and fixed to and rotating with this, on the upper side of which the supporting element 43 rests as a runner under spring load. If the spring load is increased, the pressure with which the cam follower 32 presses on the adjuster cam or the braking pressure acting on the sheet stacks reduces essentially independently of the width of the braking gap 40 set at any time. The variable spring load for each supporting element 43 is generated by a gas pressure spring in the form, for example, of a pneumatic cylinder unit 45, which carries the supporting element 43 on the lower end of its piston rod and the cylinder of which is fastened to the brake carrier 21. The spring load, which may be varied by valves in the pressure lines to and from the cylinder unit can, for example, be designed only for manual load relief setting, although setting via the controller 35 is conceivable instead of this or in addition to this. A display 46 is fitted to determine the spring load, which can be simply a manometer or pressure gauge in the case of a gas pressure spring.

Figure 4:
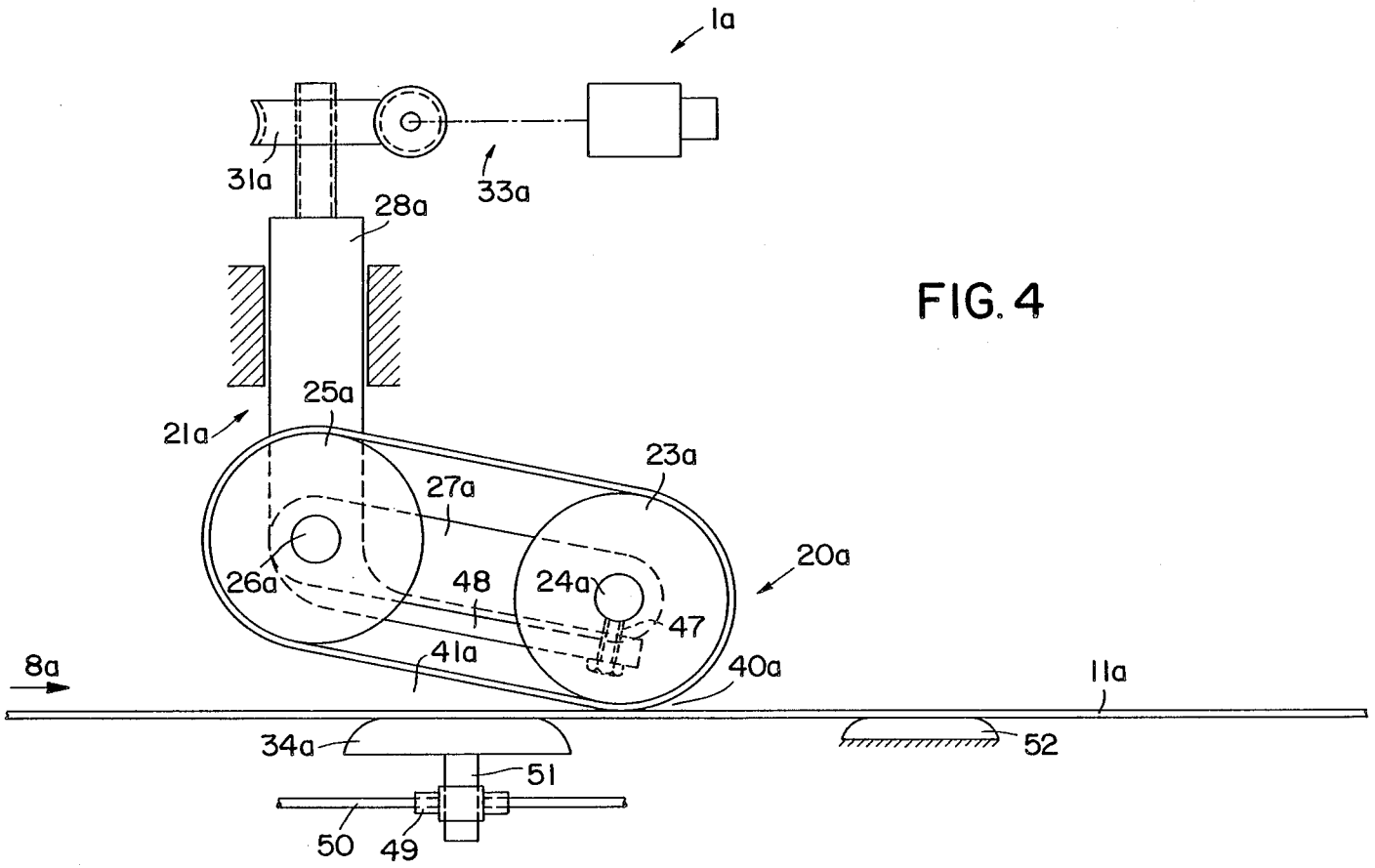
FIG. 4 shows a further design of a retarder device.

The same reference numbers are used in FIG. 4 for corresponding components in FIGS. 1 to 3, but with the index "a".

While in the design illustrated in FIGS. 1 to 3 the lifting motion for the braking element 20 is effected on a curved track and thus lifting motions necessarily simultaneously cause changes to the taper angle of the braking gap 40 or intake gap 41, a device is provided in the form illustrated in FIG. 4 to set or modify this taper angle independently of the lifting motion. This is particularly useful if, for instance, very thick sheets or high sheet stacks are being processed and despite the relatively great lift travel required caused by this height, the entry angle of the braking gap must remain substantially constant and it is necessary to guarantee that the position of the braking element **20*a* on the sheet stacks is always at the lowest point of the tail pulley 23 whatever the piston position. For this purpose the relevant upright part of the brake carrier 21*a* is guided and relocatable, i.e. it may be raised and lowered, as a sliding block 28*a* moving linearly, perpendicular to the machine frame, and driven in the two opposing directions by a suitable adjuster 31*a*. In the case illustrated, the adjuster 31*a* is constructed as a worm drive mounted over the machine frame as a wheel of a transmission from the actuator 33*a*, with a worm pinion mounted on the drive or motor shaft of the servo motor capable of engaging directly in this worm drive. The raising and lowering motion is applied via a spindle located in the axle of the adjuster 31*a* and the sliding block 28*a*, with a threaded spindle fixed the sliding block 28*a*, and engaging in a spindle thread of the adjuster 31*a***.

A guide bar **27*a*, which carries the axle 24*a* at its forward end, projecting freely in approximately the direction of travel, arrow 8*a*, is mounted at the lower end of each sliding block 28*a* on axle 26*a* or on an adjacent axle. An adjustable load relief can act as described on the guide bar or bars 27*a***.

Through the essentially free mobility of the braking element **20*a* away from the conveyor belt 11, the device 1*a* includes a safety device, which guarantees that :n the event of the counter force counteracting the preset load being exceeded, the braking element 20 can automatically swing upwards and away. Such an automatic lifting of the forward tail pulley 23*a* is particularly useful should faults occur in the overlapping range of the sheet stacks. In the case of the design illustrated in FIGS. 1 to 3, the cam follower 32 is lifted unhindered from the adjuster cam 31** under such circumstances.

Furthermore, in the design illustrated in FIG. 4 an adjusting device is provided to vary the taper angle of the braking gap **40*a* or the intake gap 41*a*. For this purpose, the forward end of the guide bar 27*a*, for example its axle 24*a*, rests on, and may be raised in the manner described from, a setting screw 47 or another adjusting element, which is located in a mount fixed to the sliding block 28*a*. In the design example illustrated, the lower end of the sliding block extends as a forwards pointing arm 48 of the substantially right-angled brake carrier 21, and the setting screw 47 is mounted at the front end of this arm 48**.

In the case of the design illustrated in FIG. 4, the brake counter-pressure element 34*a* takes the form of a table built from battens, on top of which the conveyor belt 11*a* slides, the front and/or rear end of the table having rounded transitions to the sliding surface. The counter-pressure element 34*a*, the forward long edge of which may be retracted from the lowest point of the tail pulley 23*a*, is adjustable to any position approximately parallel to the conveyor belt 11*a*, or the direction of travel, arrow 8*a*, so that its leading edge can be positioned at least approximately just before the lowest point of tail pulley 23*a*. The nearer this leading edge is located or just in front of this lowest point to the pulley 23*a*, the tighter the braking gap and the less elastically defined is the braking gap 40*a* at its lower edge. The further the forward edge of the counter-pressure element 34*a* lies behind the narrowest point of the braking gap 40*a*, the greater and more resilient the ability of the conveyor belt 11 to absorb the braking pressure imposed by the braking element. This movement may be implemented via the controller described with a suitable actuator as a function of the sensitivity of the sheets to be processed so that the counter-pressure element 34*a* is moved further backwards if a high sensitivity is input by comparison with its position for a lesser sensitivity.

The counter-pressure element 34*a* is also mounted to permit raising and lowering at approximately right-angles to the transport plane, so that, in addition to remaining flat, the conveyor belt under tension 11*a* may also be made concave by lowering or convex by raising the counter-pressure element 34*a* according to the requirements in the zone of the device 1*a*. As can be seen to the right of FIG. 4, the conveyor belt 11*a* runs obliquely downwards after the forward edge of the counter-pressure element 34*a* at a small angle away from the transport plane before this element. This raising and lowering movement could also be applied by the controller via an actuator, although manual adjusting and setting is generally sufficient, as this adjustment is principally provided to readjust the conveyor belt 11*a* because of wear to the braking element 20*a* and perhaps the conveyor belt 11*a* itself. In the design illustrated, the counter-pressure element 34*a* is mounted on a sliding block, so that, for instance, a slider 49 can be moved along a horizontal guide located beneath the counter-pressure element 34*a*, whilst the counter-pressure element 34*a* is mounted on a rod 51 which can be raised and lowered in the slider 49. Several independently adjustable rods 51 are fitted across the width (perpendicular to the drawing plane) of the table-shaped counter-pressure element 34*a*, thus allowing a curvature similar to a roller camber, permitting for instance, the braking gap to be set to different amounts across its width. The counter-pressure element 34*a* can furthermore be tipped around a transverse axle.

A further support 52 for the conveyor belt 11*a* is also located at an average distance of approximately 100 mm in the direction of travel, arrow 8, so that the belt runs freely and unsupported over a pre-specified distance between this support 52 and the counter-pressure element 34*a*, in particular in the area of, or immediately after the braking gap. This support 52 may also be constructed in the form of a table made from battens as described above. It could, of course, also have an adjustable connection for raising and lowering it, or shifting it parallel to the direction of transport, arrow 8*a*, or it may be in a fixed position in relation to slider 49, however a static mount to the machine frame is also possible and advantageous. In addition, the support 52 may also be constructed in the form of a roller or reel. This support 52 counteracts any sag in the conveyor belt in the area of the device la and in particular around the braking gap. The construction of the counter-pressure element 34*a* as a table or similar is also suitable for other designs, e.g. those illustrated in FIG. 2 or FIG. 3.

At least one of the elements constituting the braking gap in FIG. 5 is resiliently mounted or designed to be elastically resilient, at best both parts being designed in this way, to ensure that the sheet stacks are carefully gripped, in particular in the braking gap. The braking belt 22 has a relatively thick foam layer 55 as its elastically resilient core, coated on the side facing the conveyor belt with a relatively thin and hard plastics layer 54 so that this plastics layer 54 can only give flexibly by bending deformation as the foam layer 55 compresses without itself deforming under compression. The braking belt may be coated on the inner side of the core layer with a wear surface 56 with properties similar to the plastics layer 54 to engage on the tail pulleys. The top surface of the counter-pressure element 34 is also lined with a compression elastic resilient and thus absorbing layer, for example a foam layer 57 thinner than the foam layer 55, on which the conveyor belt 11 runs or rolls resiliently. This means that the conveyor belt 11 may be constructed in a substantially non-elastic and only flexibly resilient material, although it is best made in two or more layers. For example the lower support layer 58, facing away from the braking gap, can be made from a layer of plastics, laminated to the polyurethane or similar coating 59 on the side forming the braking gap. This coating 59 is most suitably relatively inelastic to compression or even hard and may only be deformed by bending, whilst the support layer 58 may have high elasticity under compression.

We claim:

1. A retarder device for assembling sheet layers of at least one sheet in a layer stream having in a normal main operating status overlapped sheet layers defining overlapped scales forming a substantially regularly varying stream thickness of said layer stream, said device comprising:

a conveyor for conveying said layer stream, said conveyor defining a conveying speed;

feeding means for feeding said sheet layers to said conveyor, said conveying speed being lower than a feeding speed defined by said feeding means;

a braking element opposing said conveyor for defining a braking gap to be passed by said layer stream, said braking element being provided to retard each sheet layer when fed to the conveyor, thereby engaging said fed sheet layer at a defined engagement pressure in the vicinity of a zone, in which said fed sheet layer overlaps at least one further layer; and means for varying a gap width of said braking gap, wherein at least one actuator means is provided for regularly and positively adjusting said engagement pressure as an adaptive function of said substantially regularly following thickness variations during said main operating status.

2. A retarder device for assembling sheet layers of at least one sheet in a layer stream having overlapped sheet layers forming a varying stream thickness of said layer stream, said device comprising:

a conveyor for conveying said layer stream, said conveyor defining a conveying speed;

feeding means for feeding said sheet layers to said conveyor, said conveying speed being lower than a feeding speed defined by said feeding means;

a braking element opposing said conveyor for defining a braking gap to be passed by said layer stream, said braking element being provided to retard each sheet layer when fed to the conveyor, thereby engaging said fed sheet layer at a defined engagement pressure; and means for varying a gap width of said braking gap, wherein means are provided for positively adjusting said engagement pressure, at least one actuator for adjusting the engagement pressure being a servo motor, said actuator means being connected to drive a mechanically acting adjuster in the form of a cam associated with a cam follower, said adjuster being mounted above the braking element in a position downstream of a bearing axis of a brake carrier, said cam follower resting on the adjuster under a contact load corresponding to a mass load, a load relief means being provided for modifying the contact load of the cam follower, said load relief means having at least one resilient spring support member in the form of a pneumatic cylinder unit, mounted on the brake carrier and supported by bearing on a substantially pitch-free cam path of the adjuster.

3. The device according to claims 1 or 2, wherein at least one said at least one actuator means is provided for substantially continuously holding said braking element in contact with said layer stream during said main operating status and for continuously adjusting said engagement pressure, said actuator being automatically regulated by a controller as a function of variation in at least one characteristic including the stream thickness of the layer stream, manually entered data, a correction value, and machine-dependent data relating to a machine status, as was as characteristics including a number of sheets per sheet layer, sheet thickness, a degree of overlapping and a value of pressure-sensitivity of the sheets.

4. The device according to claims 1 or 2, further comprising an electronic shift register means operable for registering a current position and speed of at least one of units provided by said sheet layers and said layer stream while moving on the conveyor, said shift register means controlling said engagement pressure via an actuator means.

5. The device according to claims 1 or 2, wherein a sensor is provided for controlling said engagement pressure during a substantially continuous positive pressure status of said engagement pressure.

6. The device according to claim 5, wherein said sensor is operable for sensing said stream thickness, said sensor having a sensor roller provided for running on said layer stream.

7. The device according to claim 1 or 2, wherein an actuator means is provided for regularly and adaptively widening and narrowing said braking gap in adjustment steps, substantially synchronous with steplike changes of said stream thickness of said layer stream, said braking element being provided to engage a leading edge of each of said sheet layers.

8. The device according to claims 1 or 2, wherein said braking gap tapers in a conveying direction of said conveyor, means being provided for modifying a taper angle of the braking gap independently of the engagement pressure.

9. The device according to claims 1 or 2, wherein means are provided for resiliently expanding the braking gap directly upon said layer stream acting against a variable gap closing tension control, means being provided for setting and readjusting said closing as a function of at least one of a manual control and an automatic regulating control.

10. The device according to claim 9, wherein said closing tension is defining by a mass load variable by means of a load relief means.

11. The device according to claim 9, further comprising an indicating means for indicating said gap closing tension.

12. The device according to claim 1 or 2, wherein said actuator provided for said braking element has a brake carrier mounted so that said brake carrier can be raised and lowered by opposite pivoting about an axis located upstream of said braking gap for adjusting said engagement pressure.

13. The device according to claim 1 or 2, wherein at least one said actuator means for varying the engagement pressure is a zero motor, said actuator means being connected to drive a mechanically acting adjuster in the form of a cam associated with a cam follower.

14. The device according to claim 13, wherein said adjuster is mounted above the braking element, in a position downstream of a bearing axis of a brake carrier, said cam follower resting on the adjuster under a contact load corresponding to a mass load.

15. The device according to claims 1 or 2, wherein at least one of the braking element, at least one brake counter-pressure element adjacent the conveyor and conveyor belts of the conveyor, are constructed to be resiliently elastic to compression.

16. The device according to claim 15, wherein at least one of said members has a foam layer of a material having characteristics substantially equal to polymethane.

17. The device according to claims 1 or 2, wherein a braking surface of the braking element is made from a smooth plastics coating of a material having characteristics substantially equal to tetrafluoroethylene.

18. The device according to claims 1 or 2, wherein at least one brake counter-pressure element is provided adjacent said conveyor, said counter-pressure element being mounted for performing at least one adjusting movement including shifting movements in directions substantially in and against a conveying direction, raising movements and lowering movements.

19. The device according to claim 18, wherein at least one actuator is provided for adjusting displacement of said counter-pressure element via a control means.

20. The device according to claims 1 or 2, wherein means are provided for applying a curvature to said conveyor in the vicinity of the braking gap, said means having a brake counter-pressure element and a support for a conveyor belt of the conveyor, said support being located downstream of the braking gap, said curvature being variable by adjusting at least one of members provided by said counter-pressure element and said support.

21. The device according to claims 1 or 2, wherein at least one braking counter-pressure element is at least partially formed by at least one of members provided by a profiled table and a counter-pressure roller.

22. The device according to claims 1 or 2, wherein the braking element is constructed as an endless braking belt and is guided over two tail pulleys of a brake carrier mounted to be adjustable around an axis of a rear one of said two tail pulleys.

23. The device according to claim 1, wherein at least one said at least one actuator means is provided for driving a mechanically acting adjuster having adjusting members engaging under a contact load, means being provided for modifying said contact load.

24. The device according to claims 1 or 2, wherein means are provided for applying an adjustable curvature to said conveyor in the vicinity of the braking gap, said curvature, when adjusted, being associated with a substantially continuous contact position of said breaking element.

25. A device for conveying sheet layers of at least one sheet in a layer stream providing length sections and having in a normal main operating status following sheet layers defining at least one stream thickness excursion of said layer stream, said device comprising:

a conveyor for conveying said layer stream, said conveyer defining a conveying direction;

a contact element opposing said conveyer for defining a passing gap to be passed by said layer stream, said contact element being provided to engage said sheet layers at defined engagement pressures; and, means for varying a gap width of said passing gap, wherein at least one actuator means is provided for positively adjusting said engagement pressure as a function of following length sections of said layer stream during substantial continuous contact of said contact element with substantially all of said length sections of said layer stream.

* * * * *